US008230637B2

(12) United States Patent
Lamb

(10) Patent No.: US 8,230,637 B2
(45) Date of Patent: Jul. 31, 2012

(54) HIGH-VISIBILITY GUNSIGHT

(75) Inventor: Kyle Emil Lamb, Fayetteville, NC (US)

(73) Assignee: Viking Tactics, Inc., Fayetteville, NC (US)

( * ) Notice: Subject to any disclaimer, the term of this patent is extended or adjusted under 35 U.S.C. 154(b) by 175 days.

(21) Appl. No.: 12/803,381

(22) Filed: Jun. 25, 2010

(65) Prior Publication Data

US 2011/0314721 A1 Dec. 29, 2011

(51) Int. Cl.
*F41G 1/00* (2006.01)

(52) U.S. Cl. ..... 42/145; 42/132

(58) Field of Classification Search ..... 42/111–148
See application file for complete search history.

(56) References Cited

U.S. PATENT DOCUMENTS 6,216,351 B1 * 4/2001 Flubacher et al. ..... 42/145
7,562,486 B2 * 7/2009 LoRocco ..... 42/132
7,627,976 B1 * 12/2009 Olson ..... 42/145
2008/0092424 A1 * 4/2008 Keng ..... 42/137
2009/0013581 A1 * 1/2009 LoRocco ..... 42/132
2010/0088944 A1 * 4/2010 Callihan ..... 42/145

* cited by examiner

*Primary Examiner* — Michael Carone
*Assistant Examiner* — Samir Abdosh
(74) *Attorney, Agent, or Firm* — Bennet K. Langlotz; Langlotz Patent & Trademark Works, Inc.

(57) ABSTRACT

A high-visibility gunsight has a body defining a vertical plane and having a vertically elongated rear face. The body extends from a lower base portion to an upper free end portion. A first visibility-enhancing element and a second visibility-enhancing element are connected to the body. The visibility-enhancing elements have different visibility enhancing properties. The visibility-enhancing elements are vertically aligned with each other and centered on the vertical plane. The body has a greater thickness lateral to the vertical plane at the base than at the free end. The invention also includes a rear sight operable to be aligned with the front sight along an aiming axis to form a gunsight system.

13 Claims, 3 Drawing Sheets

HIGH-VISIBILITY GUNSIGHT

FIELD OF THE INVENTION

The present invention relates to a high-visibility gunsight, and more particularly to a tapered front sight with a tritium lamp for a firearm.

BACKGROUND OF THE INVENTION

When using firearms, it is often advantageous for the user to be able to quickly and accurately point the firearm at the target. Many devices assisting in the aiming of a firearm are available, including the classic V-sight, peephole sight, 3-dot sight and similar iron-sight structures, as well as telescopic or optical sights. Standard pistol sights feature a notch in the rear sight and a blade on the front sight. The sights are aligned when the front blade is centered in the rear notch and the top of the blade is level with the top of the rear sight. However, for improved visibility, a 3-dot sight adds dots on opposed sides of the notch in the rear sight and a dot to the front sight's blade. The three dots are approximately aligned in a row when the sights are aligned.

However, when light conditions are poor, such as at night or in darkened rooms of buildings, a sighting device that relies solely on ambient light is at a disadvantage. Under such conditions, the target itself may be difficult to acquire visually and to follow if it is moving, and gunsights that are lit only by external light sources are less effective because of the need to see them and align them with the already poorly-perceived target at the time of firing the firearm.

Under poor lighting conditions, self-illuminated gunsights may be used. The dots may be elongated tritium (luminous) vials seen on end, or the dots may be fluorescent plastic rods seen on end that respond to low ambient light. However, the effectiveness of such sights still depends on the user's ability to align them accurately with a possibly poorly-seen and/or moving target.

An example of a conventional self-illuminated sighting device is Flubacher et al., U.S. Pat. No. 6,216,351, which discloses day and night weapon sights. Flubacher et al. features dual spots on each sight location in contrast to the single dot in each sight location used in 3-dot sights. The dual spots are a result of a fluorescent light guide being positioned above a tritium vial at each sight location. This improves visibility in a wide range of lighting conditions. The light guides are aligned and brought to bear on the target during daylight hours because they are more clearly visible to the user. However, during low light and night light conditions, the tritium vials are more clearly visible, allowing them to be aligned and brought to bear on a target. Therefore, the sights can be employed for both day and night usage. However, the wide sidewalls of Flubacher et al.'s front sight prevent the user from viewing substantially all of the taper present in the sidewalls of the front sight through the notch in the rear sight. This makes the front sight very difficult to acquire through the notch in the rear sight.

It is therefore an object of this invention to provide a dual-mode high-visibility gunsight that has a desirably narrow front blade while encapsulating tritium vials and fiber-optic elements.

SUMMARY OF THE INVENTION

The present invention provides an improved high-visibility gunsight, and overcomes the above-mentioned disadvantages and drawbacks of the prior art. As such, the general purpose of the present invention, which will be described subsequently in greater detail, is to provide an improved high-visibility gunsight that has all the advantages of the prior art mentioned above.

To attain this, the preferred embodiment of the present invention essentially comprises a body defining a vertical plane and having a vertically elongated rear face. The body extends from a lower base portion to an upper free end portion. A first visibility-enhancing element and a second visibility-enhancing element are connected to the body. The visibility-enhancing elements have different visibility enhancing properties. The visibility-enhancing elements are vertically aligned with each other and centered on the vertical plane. The body has a greater thickness lateral to the vertical plane at the base than at the free end. The invention also includes a rear sight operable to be aligned with the front sight along an aiming axis to form a gunsight system. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
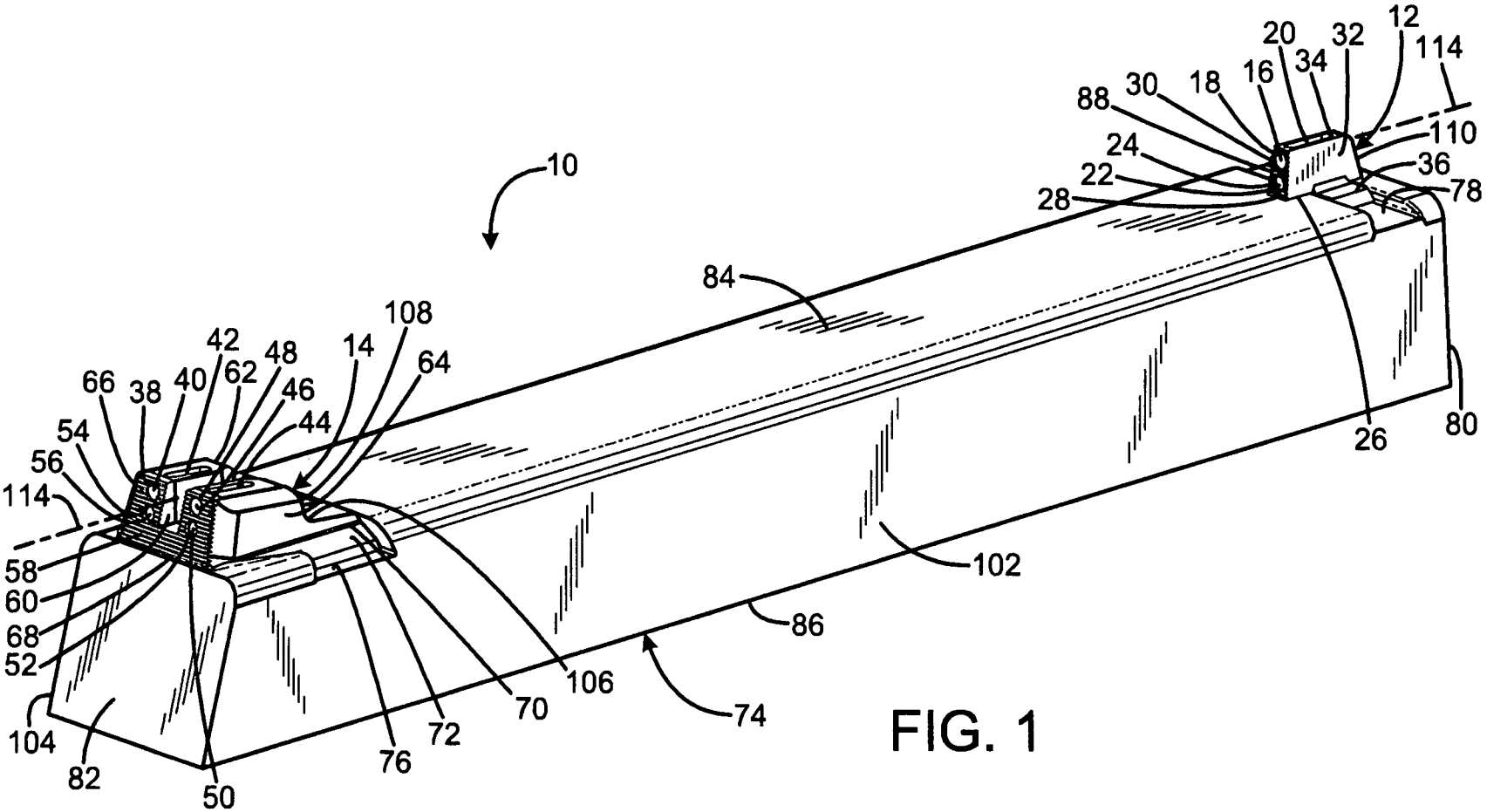
FIG. 1 is a top perspective view of the high-visibility gunsight of the present invention installed on a pistol slide.

An embodiment of the high-visibility gunsight of the present invention is shown and generally designated by the reference numeral 10.

FIG. 1 illustrates the high-visibility gunsight 10 of the present invention installed on a pistol slide 74. More particularly, the slide 74 has a front 80, a rear 82, a top 84, a bottom 86, a right side 102, and a left side 104. The slide encloses a barrel (not visible) having a barrel axis associated with an aiming axis 114 of the sights. The top front and top rear of the slide each form a dovetail slot (78, 76) that extends transversely to the length of the slide from the right side to the left side. The front sight 12 and the rear sight 14 each have a lateral dovetail mount (36, 72) that is closely received by the corresponding dovetail slot in the slide. The front and rear sights are mounted on the slide to be aligned with one another along the aiming axis 114. Although a lateral dovetail mount has been described, it should be appreciated that the front sight and rear sight herein described are also suitable for mounting to other pistol types lacking dovetail slots using conventional mounting means corresponding to those pistol types.

Figure 2:
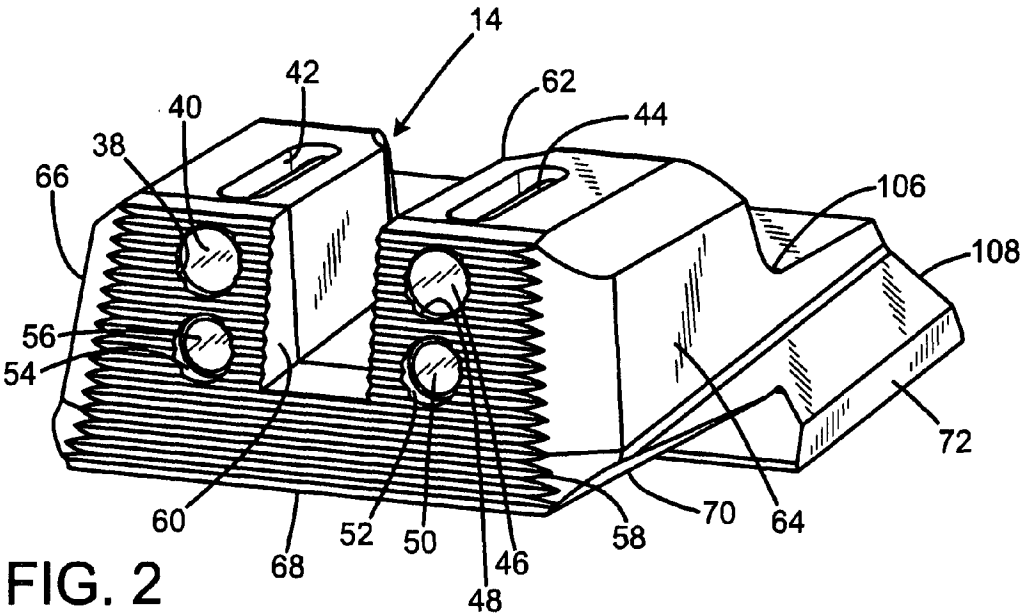
FIG. 2 is a top perspective view of the rear sight of the present invention constructed in accordance with the principles of the present invention.

FIG. 2 illustrates the rear sight 14 of the present invention. More particularly, the rear sight has a front 108, a rear 68, a top 62, a bottom 70, a right side 64, and a left side 66. The bottom front of the rear sight forms the lateral dovetail mount 72. The top front of the rear sight defines a hook cut 106. The hook cut enables one-handed operation of the slide by engaging the hook with a user's belt or other gear. A plurality of serrations 58 at 50 lines per inch is present on the rear of the rear sight to reduce glare. However, any suitable density of serrations may be used instead of the 50 lines per inch described.

The top rear of the rear sight defines a sight notch 60. In the preferred embodiment, the sight notch has a depth of 0.190 inch and a width of 0.141 inch, yielding an aspect ratio of 1.348:1. For a range of alternative applications, the depth is may vary to provide adequate visibility of the front sight dots while simultaneously avoiding having excessively tall sights that may snag or prevent smooth unholstering.

The top rear of the rear sight also defines a plurality of rear-opening bores (38, 48, 52, and 54) and top-opening apertures (42 and 44). Bore 38 receives fiber-optic element 40. Bore 48 receives fiber-optic element 46. Bore 52 receives tritium lamp 50. Bore 54 receives tritium lamp 56. Apertures 42 and 44 enable fiber-optic elements 40 and 46 to collect ambient light. Fiber-optic elements 40 and 46 are viewed on end through bores 38 and 48. Except for where the fiber-optic elements are exposed by the bores and apertures, the fiber-optic elements are completely enclosed by the rear sight. Partially enclosing the fiber-optic elements protects them from being damaged. The fiber-optic elements may be green, yellow, red, or any other desired color. The fiber-optic elements are solid rods that fluoresce in response to ambient light. The tritium lamps may be green, yellow, or any color desired for a particular application. The tritium lamps emit light because of radioactive decay.

The tritium lamps 50 and 56 are viewed on end through bores 52 and 54 and are otherwise completely enclosed by the rear sight. The tritium lamps are positioned as close to the bottom of the rear sight as possible to enable the rear sight to be as tall as possible while still providing adequate wall thickness between the tritium lamp and the external environment to provide a robust containment. It has also been observed that when the rear sight has been attached to a pistol and undergone rapid fire testing, the fiber-optic elements have experienced substantially less damage from heat than conventional sights employing fiber-optic elements. This is believed to result from the increased distance between the fiber-optic elements and the firearm, as well as the tritium lamps acting as a heat sink or insulator.

Figure 3:
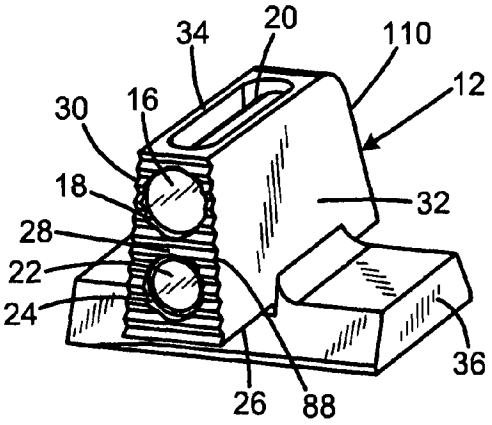
FIG. 3 is a top perspective view of the front sight of the present invention constructed in accordance with the principles of the present invention.

FIG. 3 illustrates the front sight 12 of the present invention. More particularly, the front sight has a front 110, a vertically elongated rear face 28, a top 34, a bottom 26, a planar right side face 32, and a planar left side face 30. The bottom center of the front sight forms the lateral dovetail mount 36. The left and right sides of the front sight are angled with respect to each other or tapered to make the front sight reasonably narrow at the top free end portion, where sight alignment is most critical, and wider at the base. The left side is tapered at an angle of 5 degrees with respect to vertical, and the right side is tapered at the same angle for symmetry. To provide the benefits of the taper feature, the angle of taper on each side may vary depending upon the application. A plurality of horizontal saw-tooth profile serrations 88 at 50 lines per inch is present on the rear of the front sight to reduce potential reflection or glare. However, any suitable density of serrations may be used instead of the 50 lines per inch described. The serrations are also capable of being used for elevation holds when shooting at a distance.

The top of the front sight defines a plurality of rear-opening bores (18 and 24) and a top-opening aperture 20. Bore 18 receives fiber-optic element 16. Bore 24 receives tritium lamp 22. The bores (18 and 24) are vertically aligned with each other and are each centered on the vertical plane. The alignment of the bores causes the visibility-enhancing elements each contains to be vertically aligned with each other and centered on the vertical plane. Aperture 20 enables fiber-optic element 16 to collect ambient light. Fiber-optic element 16 is viewed on end through bore 18. Except for where the fiber-optic element is exposed by the bores and apertures, the fiber optic element is completely enclosed by the front sight. Partially enclosing the fiber-optic elements protects them from being damaged. The fiber-optic element may be green, yellow, red, or any other desired color. The fiber-optic element is a solid rod that fluoresces in response to ambient light. The tritium lamp may be green, yellow, or any color desired for a particular application. The tritium lamp emits light because of radioactive decay.

The tritium lamp 22 is viewed on end through bore 24 and is otherwise completely enclosed by the front sight. The tritium lamp is positioned as close to the bottom of the front sight as possible to enable the front sight to be as tall as possible while still providing adequate wall thickness between the tritium lamp and the external environment to provide a robust containment. The front sight has a greater thickness lateral to the vertical plane at the base than it does at the upper free end. The positioning of the tritium lamp also enables the tapering of the left and right sides of the front sight. Placing the fiber-optic element at the top of the front sight enables the front sight to be significantly narrower at its top than at its bottom, limited only by the structural needs for the sight's durability. The tapering makes the front sight easier to acquire when viewed through the rear sight notch because of the added "daylight" on either side of the upper end of the front sight blade. The width of the top of the front sight is at least 0.090 inch to provide structural strength while maintaining a slim profile. The width of the bottom of the front sight is at least 0.125 inch to provide structural strength while maintaining a slim profile. It has also been observed that when the front sight has been attached to a pistol and undergone rapid fire testing, the fiber-optic element has experienced substantially less damage from heat than conventional sights employing fiber-optic elements. This is believed to result from the increased distance between the fiber-optic element and the firearm, as well as the tritium lamp acting as a heat sink or insulator.

Figure 4:
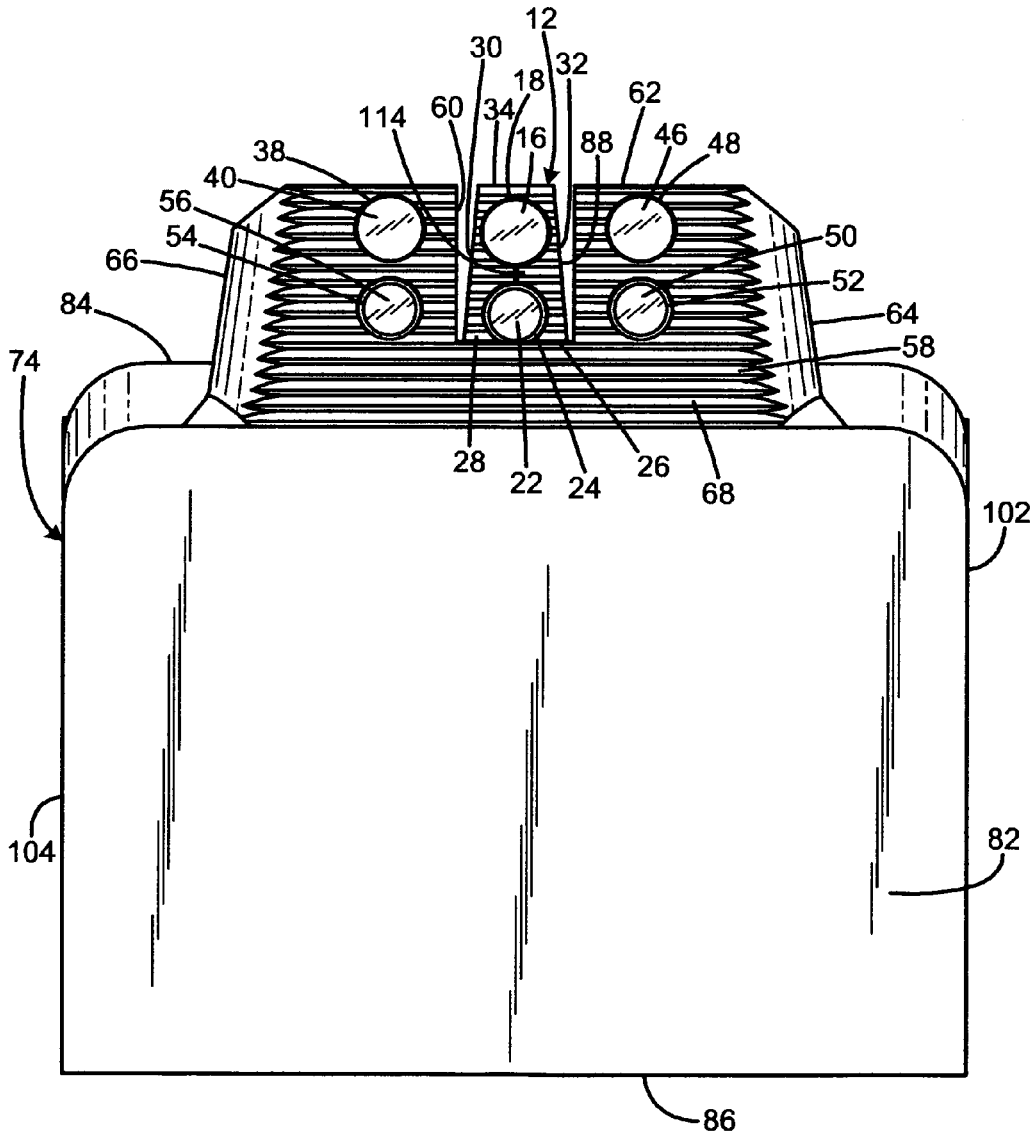
FIG. 4 is a rear view of the high-visibility gunsight of the present invention installed on a pistol slide and aligned and brought to bear on a target.

FIG. 4 illustrates the high-visibility gunsight 10 of the present invention installed on a pistol slide 74. The high-visibility gunsight 10 is shown with the front and rear sights aligned and brought to bear on a target. When the front and rear sights are aligned along an aiming axis 114 with a target in the manner depicted in FIG. 4, the user can be visually confident that the pistol is aimed properly. The user can view all of the taper present in the right and left sidewalls of the front sight through the notch in the rear sight, making the front sight easy to acquire when viewed through the rear sight notch. This is accomplished by making the notch in the rear sight wide enough and tall enough so the sight picture enables the entire front sight to be viewed through the notch in a background/foreground perspective.

In the context of the specification, the terms "rear" and "rearward" and "front" and "forward" have the following definitions: "rear" or "rearward" means in the direction away from the muzzle of the firearm, while "front" or "forward" means in the direction towards the muzzle of the firearm.

While a current embodiment of the high-visibility gunsight has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Also, while pistols with integrally-molded frames as described are the most likely contemplated application for the concepts of the present invention, it should be appreciated that the current invention may be employed on any type of pistol or firearm in addition to those with integrally-molded frames.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A high-visibility gunsight element for the front end of a pistol having a rear notch sight, the gunsight comprising:

a body defining a vertical plane and having a vertically elongated rear face;

the body extending from a lower base portion to an upper free end portion;

a first visibility-enhancing element connected to the body;

a second visibility-enhancing element connected to the body;

the first and second visibility-enhancing elements having different visibility enhancing properties;

the first and second visibility-enhancing elements being vertically aligned with each other;

the first and second visibility-enhancing elements each being centered on the vertical plane;

the body having a greater thickness lateral to the vertical plane at the base than at the free end; and the body having a greater width at the first visibility-enhancing element than at the second visibility-enhancing element.

2. The gunsight element of claim 1, further comprising the body being tapered.

3. The gunsight element of claim 1, further comprising the body having opposed side faces angled with respect to each other.

4. The gunsight element of claim 1, further comprising one of the visibility-enhancing elements including a material that emits light because of radioactive decay.

5. The gunsight element of claim 1, further comprising one of the visibility-enhancing elements including a material that fluoresces in response to ambient light.

6. A high-visibility gunsight element for the front end of a pistol having a rear notch sight, the gunsight comprising:

a body defining a vertical plane and having a vertically elongated rear face;

the body extending from a lower base portion to an upper free end portion;

a first visibility-enhancing element connected to the body;

a second visibility-enhancing element connected to the body;

the first and second visibility-enhancing elements having different visibility enhancing properties;

the first and second visibility-enhancing elements being vertically aligned with each other;

the first and second visibility-enhancing elements each being centered on the vertical plane;

the body having a greater thickness lateral to the vertical plane at the base than at the free end; and the body defining first and second bores for respectively receiving the first and second visibility enhancing elements, the body having a minimum wall thickness associated with each bore, the wall thickness associated with the lower of the bores having a greater minimum wall thickness than that of the upper of the bores, such that the lower bore may receive an element that emits light due to radioactive decay with an adequate wall thickness to provide a robust containment.

7. The gunsight element of claim 6, further comprising:

the body having tapered planar left and right sides;

the body having a top and a bottom, the top being narrower than the bottom;

the body having a rear defining a first bore; and the first bore receiving a luminous element, thereby exposing a portion of the luminous element.

8. A high-visibility gunsight system comprising:

a front sight and a rear sight mountable to a firearm so as to be aligned with one another along an aiming axis thereof;

the front sight including a body;

the front sight's body having tapered planar left and right sides;

the front sight's body having a top and a bottom, the top being narrower than the bottom;

the front sight's body having a rear defining a first bore;

the first bore receiving a luminous element, thereby exposing a portion of the luminous element;

the rear sight including a body;

the rear sight's body having a rear defining a plurality of second bores and a sight notch;

the second bores each receiving a luminous element, thereby exposing a portion of the luminous elements; and wherein the front sight has a minimum width of 0.090 inch and a maximum width of 0.125 inch.

9. The system of claim 8 wherein the sight notch is sufficiently wide and tall to enable the left and right sides of the front sight's body to be viewed in their entirety through the sight notch.

10. The system of claim 8 further comprising the rear of the front sight's body defining a third bore;

the third bore receiving a fluorescent element, thereby exposing a portion of the fluorescent element;

the rear of the rear sight's body defining a plurality of fourth bores;

the fourth bores each receiving a fluorescent element, thereby exposing a portion of the fluorescent elements.

11. The system of claim 8 further comprising:

the rear sight's body having a top;

the top of the rear sight's body defining a plurality of apertures;

the apertures each exposing a portion of one of the rear sight's fluorescent elements to the ambient environment; and the rear sight's body otherwise completely enclosing the rear sight's fluorescent elements except for the portions of the fluorescent elements exposed by the fourth bores and apertures.

12. The system of claim 8 wherein the sight notch has an aspect ratio of 1.348:1.

13. The system of claim 8 wherein the sight notch has a depth of 0.190 inch and a width of 0.141 inch.

* * * * *